US012286324B2

(12) United States Patent
Aono

(10) Patent No.: US 12,286,324 B2
(45) Date of Patent: Apr. 29, 2025

(54) POST-PROCESSING APPARATUS AND IMAGE FORMATION SYSTEM CAPABLE OF POST-PROCESSING SHEET CONVEYED FROM IMAGE FORMING APPARATUS

(71) Applicant: KYOCERA Document Solutions Inc., Osaka (JP)

(72) Inventor: Shinya Aono, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 28 days.

(21) Appl. No.: 18/369,322

(22) Filed: Sep. 18, 2023

(65) Prior Publication Data

US 2024/0101386 A1 Mar. 28, 2024

(30) Foreign Application Priority Data

Sep. 27, 2022 (JP) ..... 2022-153883

(51) Int. Cl.
*B65H 45/18* (2006.01)
*B65H 45/20* (2006.01)

(52) U.S. Cl.
CPC ..... *B65H 45/18* (2013.01); *B65H 45/20* (2013.01); *B65H 2301/44318* (2013.01); *B65H 2557/32* (2013.01); *B65H 2557/33* (2013.01); *B65H 2801/06* (2013.01); *B65H 2801/24* (2013.01)

(58) Field of Classification Search
CPC ..... B65H 45/18; B65H 45/20; B65H 2301/44318; B65H 2557/32; B65H 2557/33; B65H 2801/06; B65H 2801/24
See application file for complete search history.

(56) References Cited

U.S. PATENT DOCUMENTS 3,873,082 A * 3/1975 Imaizjmi ..... B65H 45/144 493/341
4,557,585 A * 12/1985 Abuyama ..... G03G 15/04 399/210
5,105,225 A * 4/1992 Honjo ..... G03G 15/60 399/361
7,736,290 B2 * 6/2010 Oshiro ..... B65H 45/18 493/425

(Continued)

FOREIGN PATENT DOCUMENTS

JP 2008156113 A 7/2008

*Primary Examiner* — Dariush Seif
(74) *Attorney, Agent, or Firm* — IP Business Solutions, LLC.

(57) ABSTRACT

A post-processing apparatus includes a blade, a transfer mechanism, a sheet folding roller pair, a motor, a drive control device, and a control device. The blade presses into the sheet to form a fold line in the sheet. The transfer mechanism moves the blade toward and away from the sheet. The sheet folding roller pair conveys the sheet with the fold line formed by the blade by pinching the sheet at a nip between the sheet folding roller pair. The motor rotatively drives the sheet folding roller pair. The drive control device controls drive of the motor. The control includes a control circuit. When, through the processor executing a control program, the control device controls the transfer mechanism to withdraw from the nip the blade having been pressed into the sheet and the nip by the transfer mechanism, the control device controls the drive control device to stop the motor.

2 Claims, 9 Drawing Sheets

(56) References Cited

U.S. PATENT DOCUMENTS 8,600,287 B2 * 12/2013 Takahashi ..... B65H 45/142 399/407
8,851,464 B2 * 10/2014 Shimizu ..... B65H 45/18 270/32
9,938,108 B2 * 4/2018 Noso ..... B65H 29/125
2004/0022557 A1 * 2/2004 Kudo ..... G03G 15/757 399/167
2006/0181753 A1 * 8/2006 Kawai ..... H04N 1/1135 359/205.1
2007/0013118 A1 * 1/2007 Ruthenberg ..... B65H 45/18 270/37
2008/0048386 A1 * 2/2008 Smith ..... B65H 29/241 271/194
2008/0100690 A1 * 5/2008 Kitao ..... G03G 15/043 347/232
2008/0150211 A1 * 6/2008 Iguchi ..... B65H 39/10 270/37
2008/0166150 A1 * 7/2008 Osada ..... G03G 15/0435 399/301
2008/0182740 A1 * 7/2008 Fukasawa ..... G03G 15/6582 399/361
2008/0185763 A1 * 8/2008 Iguchi ..... B65H 37/04 270/37
2008/0315514 A1 * 12/2008 Iguchi ..... B65H 45/18 271/270
2009/0033018 A1 * 2/2009 Taguchi ..... B41L 43/02 270/58.08
2009/0051751 A1 * 2/2009 Fuse ..... H04N 1/053 347/249
2009/0200724 A1 * 8/2009 Iguchi ..... B65H 37/04 270/8
2010/0097434 A1 * 4/2010 Rabbani ..... B65H 45/18 347/104
2010/0189453 A1 * 7/2010 Ogasahara ..... H04N 1/2323 399/51
2010/0254782 A1 * 10/2010 Yonekawa ..... B65H 9/06 271/3.14
2012/0007529 A1 * 1/2012 Kim ..... H02P 6/34 318/400.04
2012/0046154 A1 * 2/2012 Takeuchi ..... B65H 45/18 493/405
2012/0065044 A1 * 3/2012 Tsuno ..... B65H 45/30 493/416
2012/0184423 A1 * 7/2012 Hattori ..... B65H 45/18 493/405
2012/0230716 A1 * 9/2012 Furuichi ..... G03G 15/0189 399/302
2013/0095991 A1 * 4/2013 Ishida ..... B65H 45/18 493/444
2015/0086298 A1 * 3/2015 Kubota ..... B65H 31/00 412/16
2015/0117983 A1 * 4/2015 Kubota ..... G03G 15/00 412/35
2015/0336763 A1 * 11/2015 Otsu ..... B65H 5/32 493/434
2015/0375957 A1 * 12/2015 Fukasawa ..... B65H 45/18 100/153
2016/0264374 A1 * 9/2016 Katsumata ..... B65H 31/02
2016/0291508 A1 * 10/2016 Mashiki ..... G03G 15/0851
2016/0313687 A1 * 10/2016 Osada ..... B42C 3/00
2017/0008723 A1 * 1/2017 Shimizu ..... B65H 37/06
2017/0242388 A1 * 8/2017 Matsuno ..... B65H 31/02
2017/0302203 A1 * 10/2017 Takatsu ..... H04N 1/0057
2018/0111785 A1 * 4/2018 Nakano ..... B65H 31/3081
2019/0039853 A1 * 2/2019 Taguchi ..... B65H 45/18
2019/0367312 A1 * 12/2019 Kishimoto ..... B65H 31/02
2020/0148499 A1 * 5/2020 Shin ..... B65H 45/16
2021/0191288 A1 * 6/2021 Ishido ..... G03G 15/065
2021/0198077 A1 * 7/2021 Katayama ..... B65H 45/18
2022/0089401 A1 * 3/2022 Murata ..... B65H 37/06
2022/0089402 A1 * 3/2022 Murata ..... B65H 45/30
2022/0177258 A1 * 6/2022 Kubota ..... B65H 31/02
2022/0185613 A1 * 6/2022 Egawa ..... B65H 45/18
2022/0185617 A1 * 6/2022 Shimizu ..... B65H 45/18
2022/0214638 A1 * 7/2022 Fukasawa ..... B65H 45/18
2022/0411225 A1 * 12/2022 Kobayashi ..... B65H 45/18
2024/0101386 A1 * 3/2024 Aono ..... B65H 45/20

* cited by examiner

POST-PROCESSING APPARATUS AND IMAGE FORMATION SYSTEM CAPABLE OF POST-PROCESSING SHEET CONVEYED FROM IMAGE FORMING APPARATUS

INCORPORATION BY REFERENCE

This application claims priority to Japanese Patent Application No. 2022-153883 filed on Sep. 27, 2022, the entire contents of which are incorporated by reference herein.

BACKGROUND

The present disclosure relates to post-processing apparatuses and image formation systems and particularly relates to a post-processing apparatus that post-processes a sheet conveyed from an image forming apparatus.

Optional apparatuses for an image forming apparatus, such as a copying machine or a multifunction peripheral, include a post-processing apparatus (a finisher) capable of performing multiple types of sheet folding processing. The types of sheet folding processing include, as shown as examples in FIGS. 7A to 7D, Z-folding, double folding, inwardly triple folding, and outwardly triple folding. These types of sheet folding processing are done by passing a portion of a sheet to be a fold line through a nip defined between a pair of sheet folding rollers.

FIGS. 8A to 8D are views illustrating an example of Z-folding processing for a sheet performed by a post-processing apparatus. A post-processing apparatus 20 includes a first sheet folding roller pair 31 and a second sheet folding roller pair 32. The post-processing apparatus 20 passes a first folding portion PT1 of a sheet P to be a first fold line through a nip N1 between the first sheet folding roller pair 31 to form a first fold line in the sheet P (first sheet folding processing) and then conveys the sheet P with the first fold line formed therein to a subsequent stage (first conveyance processing).

Subsequently, the post-processing apparatus 20 passes a second folding portion PT2 of the sheet P to be a second fold line through a nip N2 between the second sheet folding roller pair 32 to form a second fold line in the sheet P (second sheet folding processing) and then conveys the sheet P with the second fold line formed therein to a subsequent stage (second conveyance processing). Thus, a Z-fold of the sheet P is achieved.

SUMMARY

A technique improved over the aforementioned technique is proposed as one aspect of the present disclosure.

A post-processing apparatus according to one aspect of the present disclosure is a post-processing apparatus mounted to an image forming apparatus and capable of subjecting a sheet to post-processing and includes a blade, a transfer mechanism, a sheet folding roller pair, a motor, a drive control device, and a control device. The blade presses into the sheet to form a fold line in the sheet. The transfer mechanism moves the blade toward and away from the sheet. The sheet folding roller pair conveys the sheet with the fold line formed therein by the blade by pinching the sheet at a nip between the sheet folding roller pair. The motor rotatively drives the sheet folding roller pair. The drive control device controls drive of the motor. The control device is formed of a control circuit including a processor and controls the transfer mechanism and the drive control device. At a time when the control device controls the transfer mechanism to withdraw the blade, which has been pressed into the sheet and the nip by the transfer mechanism, from the nip, the control device controls the drive control device to stop the motor.

An image formation system according to another aspect of the present disclosure includes: an image forming apparatus including an image forming device that forms an image on a recording medium; and the post-processing apparatus according to the one aspect of the present disclosure.

DETAILED DESCRIPTION

Hereinafter, a description will be given of an image formation system 10 according to an embodiment as one aspect of the present disclosure with reference to the drawings.

Figure 1:
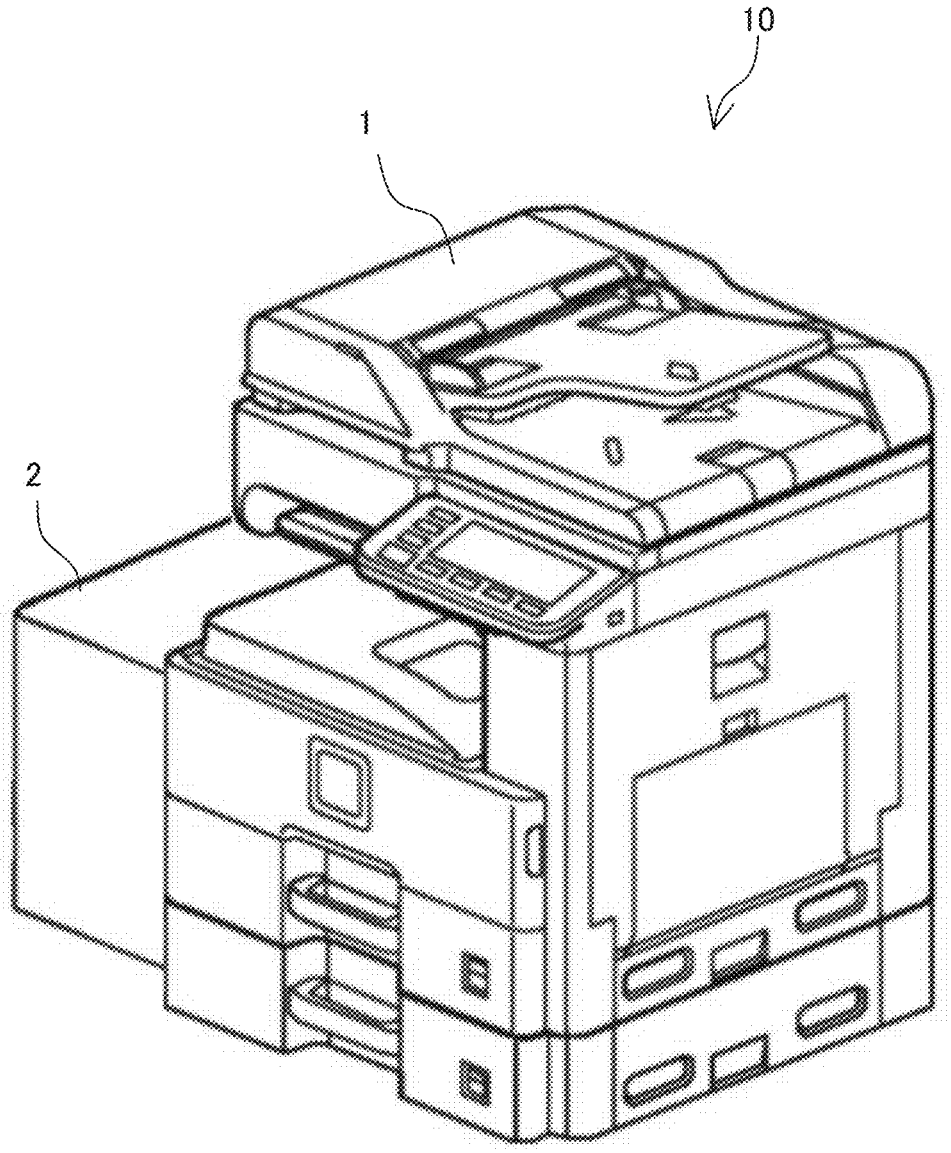
FIG. 1 is a perspective view showing the appearance of an image formation system made up by including a post-processing apparatus according to an embodiment of the present disclosure.

FIG. 1 is a perspective view showing the appearance of the image formation system 10 made up by including a post-processing apparatus according to an embodiment of the present disclosure. The image formation system 10 includes: an image forming apparatus 1 that forms an image on a sheet; and a post-processing apparatus 2 provided lateral to the image forming apparatus 1.

The image forming apparatus 1 is a multifunction peripheral combining a plurality of functions, such as, for example, a copy function, a print function, a scan function, and a facsimile function. The post-processing apparatus 2 can subject a sheet conveyed from the image forming apparatus 1 to multiple types of post-processing. The types of sheet folding processing include, as shown as examples in FIGS. 7A to 7D, Z-folding, double folding, inwardly triple folding, and outwardly triple folding.

Figure 2:
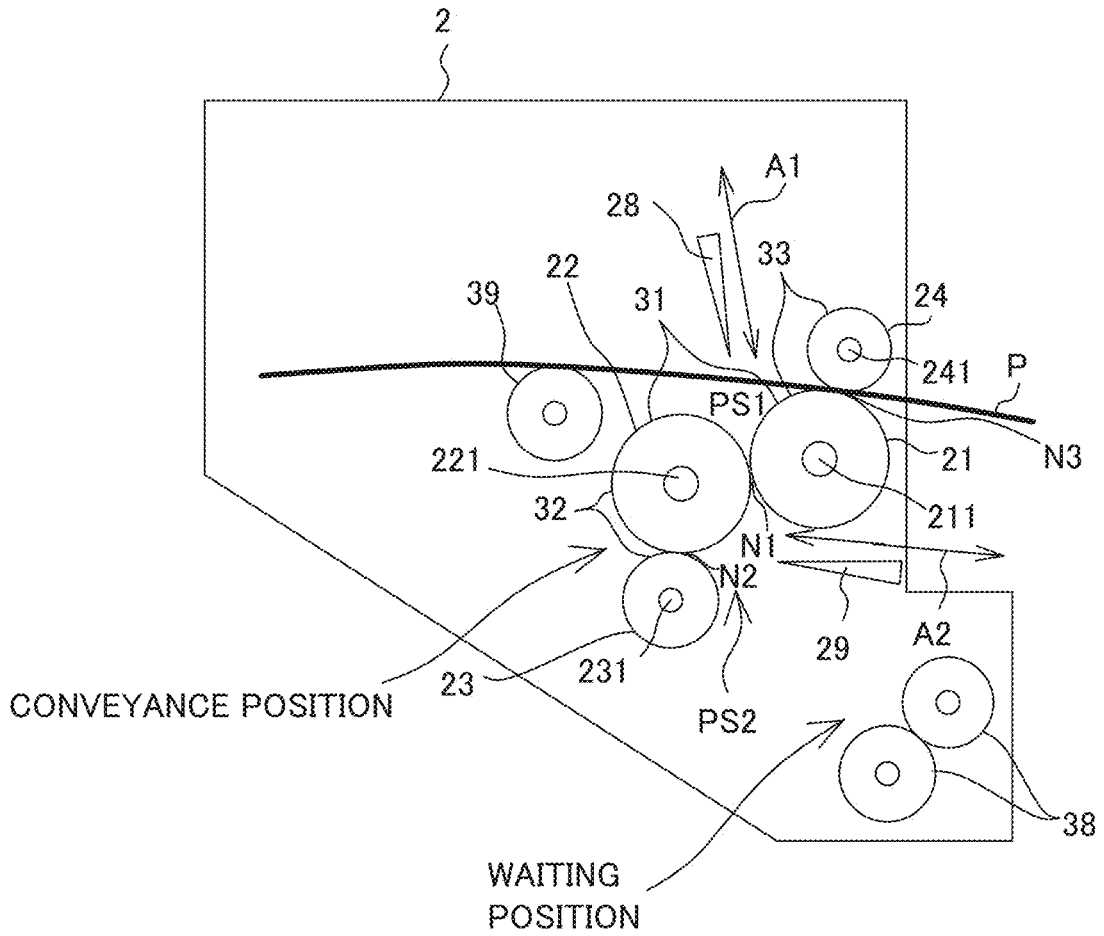
FIG. 2 is a front view schematically showing a portion of the structure of the post-processing apparatus.

FIG. 2 is a front view showing a portion of the structure of the post-processing apparatus 2. The post-processing apparatus 2 includes: conveyance rollers 21 to 24 that convey a sheet P conveyed from the image forming apparatus 1 (from the right of the post-processing apparatus 2 in FIG. 2): a first blade 28; and a second blade 29. The conveyance roller 21 rotates with a rotating shaft 211 as a central axis connected to a roller motor 41 (see FIG. 3) to be described hereinafter. The roller motor 41 is an example of the motor defined in CLAIMS.

The conveyance roller 22 is pressed against the conveyance roller 21, forms a first sheet folding roller pair 31 with the conveyance roller 21 to have a nip N1 where the sheet P is pinched between both the conveyance rollers 21 and 22, and is driven into rotation with a rotating shaft 221 as a central axis. The first sheet folding roller pair 31 folds the sheet P at the nip N1 and conveys the sheet P thus having a fold line formed therein to a waiting position (see FIG. 2).

The conveyance roller 23 is pressed against the conveyance roller 22, forms a second sheet folding roller pair 32 with the conveyance roller 22 to have a nip N2 where the sheet P is pinched between both the conveyance rollers 22 and 23, and is driven into rotation with a rotating shaft 231 as a central axis. Like the first sheet folding roller pair 31, the second sheet folding roller pair 32 folds the sheet P at the nip N2 and conveys the sheet P thus having a fold line formed therein to a conveyance position (see FIG. 2).

The conveyance roller 24 is pressed against the conveyance roller 21, forms a conveyance roller pair 33 with the conveyance roller 21 to have a nip N3 where the sheet P is pinched between both the conveyance rollers 21 and 24, and is driven into rotation with a rotating shaft 241 as a central axis.

The first blade 28 is a thin plate member for use in pressing the sheet P into the nip N1 of the first sheet folding roller pair 31 and is provided linearly reciprocably in the direction of the arrow A1 by a blade motor 431 (see FIG. 3) to be described hereinafter. The second blade 29 is likewise a thin plate member for use in pressing the sheet P into the nip N2 of the second sheet folding roller pair 32 and is provided linearly reciprocably in the direction of the arrow A2 by a blade motor 441 (see FIG. 3) to be described hereinafter.

Figure 8A:
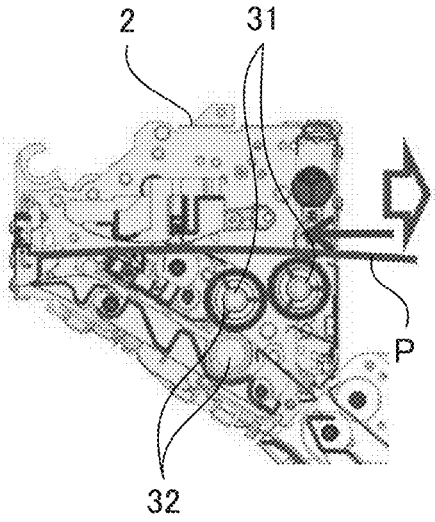
Fig.8A RELATED ART
FIGS. 8A to 8D are views illustrating an example of Z-folding processing for a sheet performed by the post-processing apparatus.
Figure 8B:
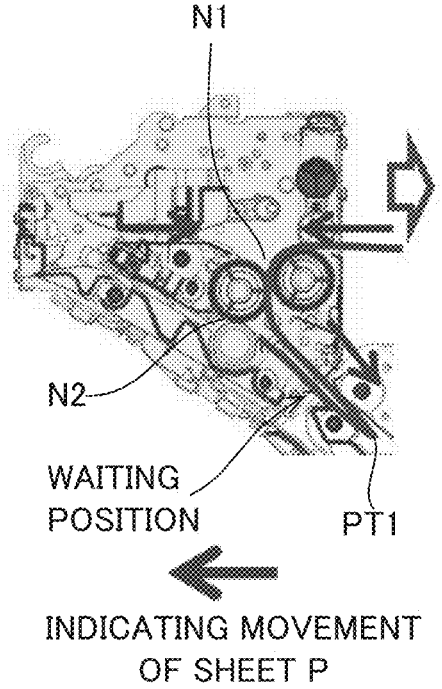
Fig.8B RELATED ART
Figure 8C:
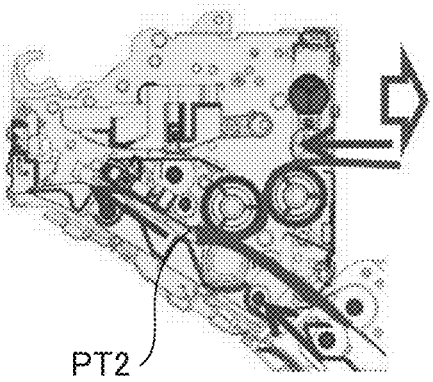
Fig.8C RELATED ART
Figure 8D:
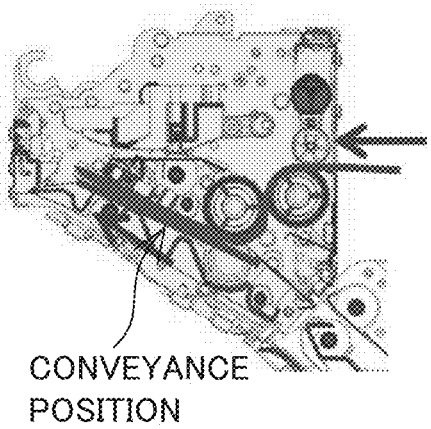
Fig.8D RELATED ART

Here, a description will be given of the case where the post-processing apparatus 2 subjects the sheet P to Z-folding processing with reference to FIG. 2. The flow of the processing is the same as already discussed with reference to FIGS. 8A to 8D. The post-processing apparatus 2 allows the conveyance roller 21 to rotate counterclockwise in FIG. 2 to convey the sheet P, which has been conveyed from the image forming apparatus 1, until a first folding portion PT1 of the sheet P (see FIG. 8B) reaches a predetermined first position PS1 (above the nip N1 in FIG. 2). When the first folding portion PT1 of the sheet P reaches the first position PS1, the post-processing apparatus 2 moves the first blade 28 toward the sheet P to press the sheet P into the nip N1. Then, the post-processing apparatus 2 allows the conveyance roller 21 to rotate again to pass the first folding portion PT1 of the sheet P to be a fold line through the nip N1, thus forming a first fold line in the sheet P. The post-processing apparatus 2 conveys the sheet P with the first fold line formed therein to the waiting position.

When a second folding portion PT2 (see FIG. 8C) of the sheet P reaches a predetermined second position PS2 (to the right of the nip N2), the post-processing apparatus 2 uses the second blade 29 to press the sheet P into the nip N2. Then, the post-processing apparatus 2 allows the conveyance roller 21 to rotate again to pass the second folding portion PT2 of the sheet P to be a fold line through the nip N2, thus forming a second fold line in the sheet P. The post-processing apparatus 2 conveys the sheet P with the second fold line formed therein to the conveyance position.

Figure 3:
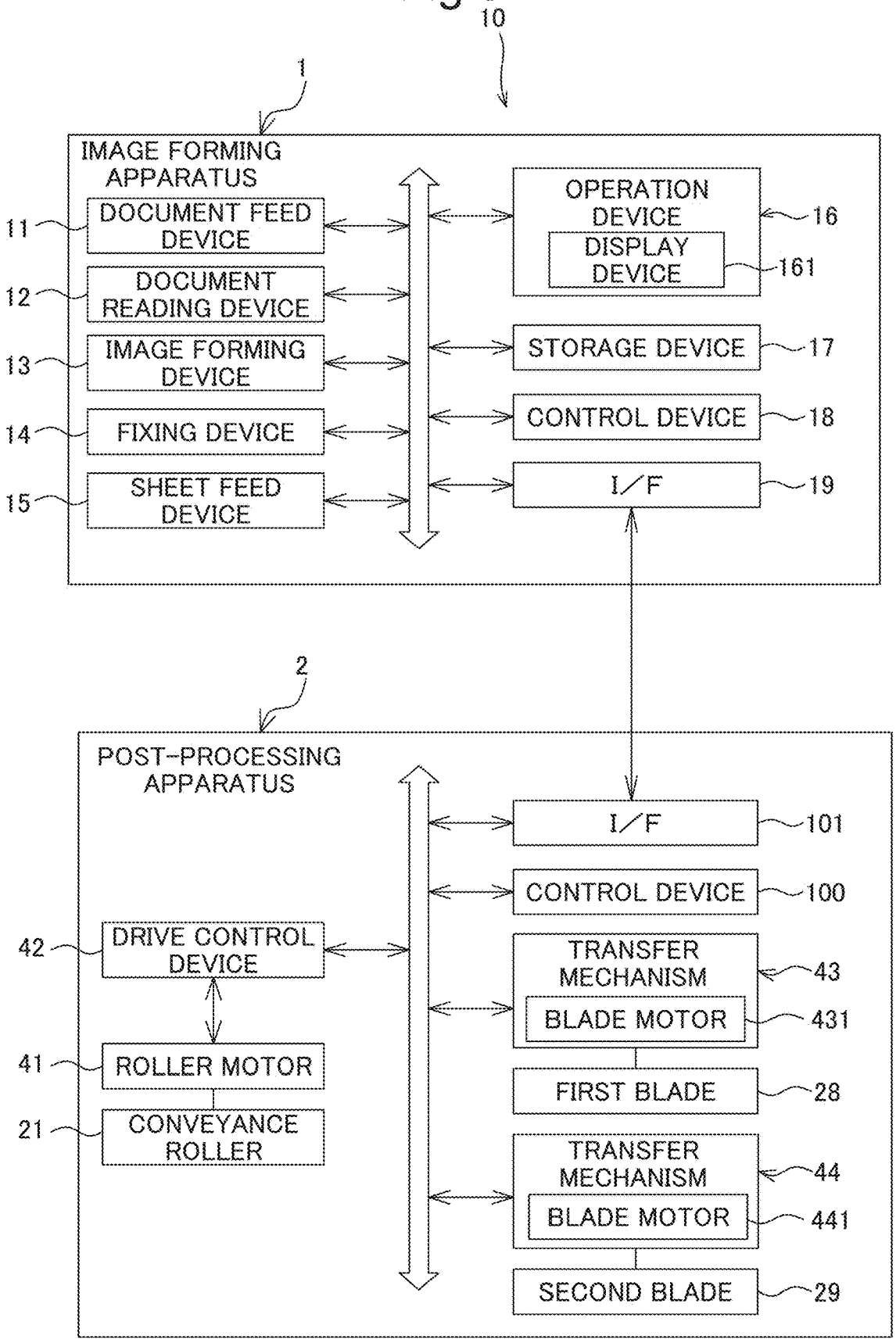
FIG. 3 is a functional block diagram schematically showing an essential internal configuration of the image formation system.

FIG. 3 is a functional block diagram schematically showing an essential internal configuration of the image formation system 10.

The image forming apparatus 1 is made up by including a document feed device 11, a document reading device 12, an image forming device 13, a fixing device 14, a sheet feed device 15, an operation device 16, a storage device 17, a control device 18, and a communication interface (I/F) 19.

The document feed device 11 is capable of being opened and closed with respect to the document reading device 12 by being mounted by unshown hinges or the like on the top of the document reading device 12, and functions as a document holding cover in reading an original document sheet placed on an unshown platen glass. Furthermore, the document feed device 11 is an automatic document feed device called an ADF (auto document feeder), includes an unshown document loading tray, and feeds original document sheets loaded onto the document loading tray to the document reading device 12 sheet by sheet.

First, a description will be given of the case where a document reading operation is performed on the image forming apparatus 1. The document reading device 12 optically reads an image of an original document sheet fed to the document reading device 12 by the document feed device 11 or an image of an original document sheet placed on the platen glass and generates image data on the original document sheet. The image data generated by the document reading device 12 is saved in an unshown image memory or the like.

Next, a description will be given of the case where an image forming operation is performed under the control of the control device 18 on the image forming apparatus 1. Based on image data generated by the document reading operation, image data stored in the image memory or the like, image data received from a computer connected via a network or other image data, the image forming device 13 forms a toner image on a sheet as a recording medium fed from the sheet feed device 15.

The fixing device 14 applies heat and pressure to the sheet bearing the toner image formed by the image forming device 13, thus fixing the toner image on the sheet. The sheet subjected to the fixation processing is conveyed to the post-processing apparatus 2. The sheet feed device 15 includes at least one sheet feed cassette.

The operation device 16 accepts from an operator instructions for various types of operations and processing executable by the image forming apparatus 1, such as an instruction to execute an image forming operation. The operation device 16 includes a display device 161 that displays operation guidance and other types of information for the operator. Furthermore, the operation device 16 accepts, through a touch panel provided on the display device 161, the input of an operator's instruction based on an operator's gesture (a touch gesture) on an operation screen being displayed on the display device 161.

Alternatively, the operation device 16 accepts the input of an operator's instruction based on an operator's operation on any physical key provided on the operation device 16.

The display device 161 is formed of an LCD (liquid crystal display) or the like. The display device 161 is equipped with a touch panel. When the operator makes a touch gesture on a button or key being displayed on the screen, the touch panel accepts an instruction associated with a point where the touch gesture has been made.

The storage device 17 is a large storage device, such as an HDD (hard disk drive) or an SSD (solid state drive), and stores various types of control programs.

The control device 18 is made up by including a processor, a RAM (random access memory), a ROM (read only memory), and a dedicated hardware circuit. The processor is, for example, a CPU (central processing unit), an ASIC (application specific integrated circuit) or an MPU (micro processing unit). The control device 18 executes a control program stored in the above ROM or the storage device 17 to function as a processor that executes various types of processing necessary for image formation by the image forming apparatus 1.

The control device 18 governs the overall operation control of the image forming apparatus 1. The control device 18 is connected to the document feed device 11, the document reading device 12, the image forming device 13, the fixing device 14, the sheet feed device 15, the operation device 16, the storage device 17, and the communication interface 19 and controls the operations and so on of these devices.

The post-processing apparatus 2 includes a roller motor 41 as a drive source of the conveyance roller 21, a drive control device 42, a transfer mechanism 43 for the first blade 28, a transfer mechanism 44 for the second blade 29, a control device 100, and a communication interface (I/F) 101. These components can transmit and receive data or signals to and from each other via a bus.

The control device 100 is formed of a control circuit including a processor, a RAM, a ROM, and so on. The control device 100 is connected to the drive control device 42, the transfer mechanisms 43 and 44, and the communication interface 101 and controls the operations and so on of these components. The control device 100 drives the above components in accordance with a control signal sent from the control device 18 of the image forming apparatus 1, thus allowing them to perform a post-processing operation. The control signal is an instruction signal output by the control device 18 of the image forming apparatus 1 so that post-processing appropriate to the image forming operation performed on the image forming apparatus 1 can be performed in proper timing with the image forming operation. Then, the control device 100 outputs, in accordance with the control signal, for example, an instruction signal indicating a target rotational speed for the roller motor 41 to the drive control device 42.

The roller motor 41 is, for example, a brushless DC motor. The drive control device 42 includes a motor driver or the like made of, for example, a circuit and controls the drive of the roller motor 41 by performing PLL (phase locked loop) control. For example, the drive control device 42 compares, based on the instruction signal acquired from the control device 100, the rotational speed of the roller motor 41 with the target rotational speed for the roller motor 41, generates a drive signal causing the rotational speed of the roller motor 41 to reach the target rotational speed, and sends the generated drive signal to the roller motor 41. In this manner, the roller motor 41 is driven by feedback control.

Furthermore, the drive control device 42 controls the drive of the roller motor 41 by PWM (pulse width modulation) control. The above drive signal sent to the roller motor 41 by the drive control device 42 is a PWM signal.

The transfer mechanism 43 is a mechanism that reciprocates the first blade 28 in the direction of the arrow A1 (see FIG. 2) by linear movement or axially rotational movement. Here, the transfer mechanism 43 will be explained using as an example a structure where it includes a blade motor 431 and reciprocates the first blade 28 linearly in the direction of the arrow A1 by the rotation of the blade motor 431.

In a conveyance path in the post-processing apparatus 2 in which the sheet P fed from the image forming apparatus 1 is conveyed, a sheet detection sensor formed of an optical sensor or other type of sensor is provided just upstream of the nip N1 of the first sheet folding roller pair 31 in the direction of sheet conveyance. The control device 100 allows the drive control device 42 to stop the drive of the roller motor 41 when a predetermined period of time has elapsed (or a predetermined motor pulse count has been reached) after the sheet detection sensor detects a leading end of the sheet P being conveyed along the conveyance path. Subsequently, the control device 100 drives the blade motor 431 to move the first blade 28 toward the sheet P so that the first blade 28 reaches the first folding portion PT1 of the sheet P. The predetermined period of time (or the predetermined motor pulse count) is a period of time (or a motor pulse count) required for the first folding portion PT1 of the sheet P to reach the nip N1 from the above time of detection of the sheet P at a sheet conveyance speed in the conveyance path and is previously set by experiment or calculation. A detection signal sent from the sheet detection sensor and indicating detection of a leading end of a sheet is output to the control device 100.

The transfer mechanism 44 is a mechanism that reciprocates the second blade 29 linearly in the direction of the arrow A2 (see FIG. 2). The transfer mechanism 44 includes a blade motor 441 and reciprocates the second blade 29 linearly in the direction of the arrow A2 by the rotation of the blade motor 441.

In the above conveyance path, a sheet detection sensor similar to the above sheet detection sensor is provided just upstream of the nip N2 of the second sheet folding roller pair 32 in the direction of sheet conveyance. The control device 100 allows the drive control device 42 to stop the drive of the roller motor 41 when a predetermined period of time has elapsed (or a predetermined motor pulse count has been reached) after the sheet detection sensor detects a leading end of the sheet P being conveyed along the conveyance path. The control device 100 drives the blade motor 441 to move the second blade 29 toward the sheet P so that the second blade 29 reaches the second folding portion PT2 of the sheet P. The predetermined period of time (or the predetermined motor pulse count) is a period of time (or a motor pulse count) required for the second folding portion PT2 of the sheet P to reach the nip N2 from the above time of detection of the sheet P at the sheet conveyance speed in the conveyance path and is previously set by experiment or calculation. A detection signal sent from the sheet detection sensor and indicating detection of a leading end of a sheet is output to the control device 100.

In performing processing for forming a first fold line in the sheet P (a first sheet folding processing), the control device 100 controls the transfer mechanism 43 to cause the first blade 28 to create a fold line at the first folding portion PT1 of the sheet P. Thereafter, at the time when, under the control of the control device 100, the first blade 28 having been pressed into the sheet P and the nip N1 between the first sheet folding roller pair 31 is withdrawn from the nip N1, the drive control device 42 stops the roller motor 41 until a predetermined period of time T elapses.

Furthermore, in performing processing for forming a second fold line in the sheet P (a second sheet folding processing), as in the processing for forming a first fold line, the control device 100 controls the transfer mechanism 44 to cause the second blade 29 to create a fold line at the second folding portion PT2 of the sheet P. Thereafter, at the time when, under the control of the control device 100, the second blade 29 having been pressed into the sheet P and the nip N2 between the second sheet folding roller pair 32 is withdrawn from the nip N2, the drive control device 42 stops the roller motor 41 until a predetermined period of time T elapses.

Figure 4:
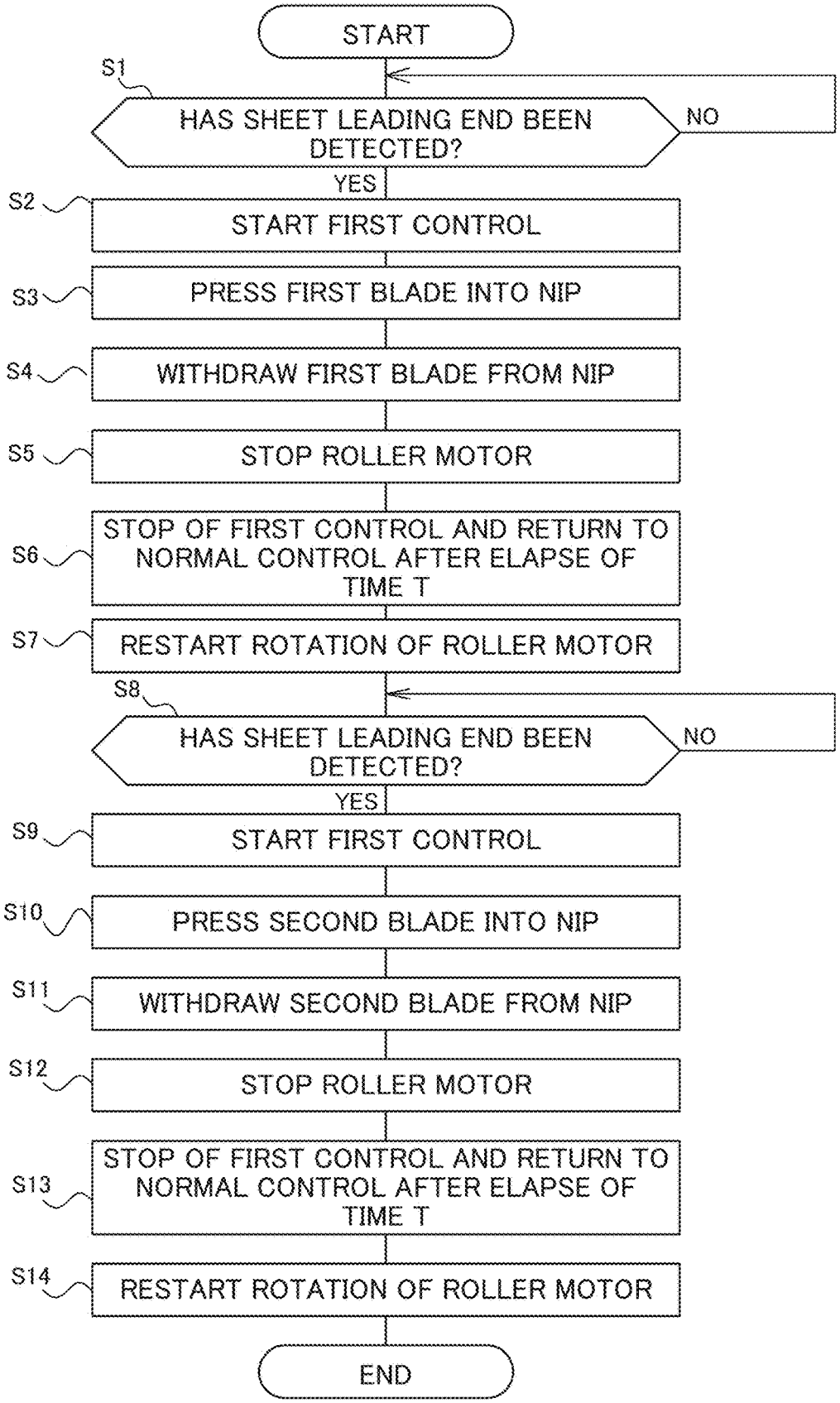
FIG. 4 is a flowchart showing an example of processing performed by a control device of the post-processing apparatus.

Next, a description will be given of an example of processing performed by the control device 100 of the post-processing apparatus 2, with reference to the flowchart shown in FIG. 4. For example, this processing is performed in subjecting a sheet P, which has been subjected to an image forming operation on the image forming apparatus 1, to Z-folding on the post-processing apparatus 2.

The drive control device 42 drives the roller motor 41 by PLL control in which the motor pulse is synchronized with the clock serving as a basis of an instruction for the rotational speed and by controlling the speed and amount of movement of a sheet by PWM control of the time to energize the motor. The control device 100 determines, based on the detection signal from the sheet detection sensor located just upstream of the nip N1, whether the leading end of the sheet P in the direction of sheet conveyance has been detected (S1).

When determining that the leading end of the sheet P has been detected (YES in S1), the control device 100 allows the drive control device 42 to drive the roller motor 41 by the above PWM control and PLL control from this time of detection. When the predetermined period of time has elapsed (or the predetermined motor pulse count has been reached) after the above time of detection, the control device 100 allows the drive control device 42 to stop the drive of the roller motor 41. Subsequently, the control device 100 allows the drive control device 42 to perform a first control which is a fixed time control where the number of clocks is fixed (S2), and drives the blade motor 431 to move the first blade 28 toward the sheet P so that the first blade 28 reaches the first folding portion PT1 of the sheet P (S3).

In other words, the control device 100 starts the first sheet folding processing and controls the blade motor 431 to press the first blade 28 into the nip N1. At this time, the control device 100 allows the drive control device 42 to drive the roller motor 41 to rotate a conveyance roller 39, which is located downstream of the first sheet folding roller pair 31 in the direction of sheet conveyance, so that its direction of rotation along the circumference is opposite to the direction of sheet conveyance.

When a predetermined period of time of pressing has elapsed after the control device 100 controls the blade motor 431 to allow the first blade 28 to start pressing the sheet P into the nip N1, the control device 100 rotates the blade motor 431 reversely (S4) to withdraw the first blade 28 from the sheet P and the nip N1.

At the time when the control device 100 rotates the blade motor 431 reversely to withdraw the first blade 28 from the sheet P and the nip N1 (for example, at the time when the first blade 28 goes back to an initial position before the transfer in S2), the control device 100 controls the drive control device 42 to stop the rotation of the roller motor 41 (S5).

When determining that the predetermined period of time T has elapsed after the stop of rotation of the roller motor 41 in S5, the control device 100 allows the drive control device 42 to return the control of the roller motor 41 to, not the first control, but a normal PLL control and PWM control having been performed before the processing in S1, drive the roller motor 41 by the normal PLL control and PWM control (S6), and restart the rotation of the roller motor 41 (S7), thus conveying the sheet P with a first fold line formed therein to the above waiting position. Since in this manner the rotation of the roller motor 41 is once stopped and then restarted, the accumulated gap between the pulse and the number of clocks due to the first control does not affect sheet conveyance control after the restart. The period of time for which the drive control device 42 performs the first control is sufficient to be at least a period of time from when the control device 100 drives the transfer mechanism 43 to allow the first blade 28 to start pressing into the sheet P to when the control device 100 drives the transfer mechanism 43 to allow the first blade 28 to end the pressing.

Subsequently, the control device 100 determines, based on the detection signal from the sheet detection sensor located just upstream of the nip N2, whether the leading end of the sheet P in the direction of sheet conveyance has been detected (S8). When determining that the leading end of the sheet P has been detected (YES in S8), the control device 100 controls the drive control device 42 to drive the roller motor 41 by the above PWM control and PLL control from this time of detection. When the predetermined period of time has elapsed (or the predetermined motor pulse count has been reached) after the above time of detection, the control device 100 allows the drive control device 42 to stop the drive of the roller motor 41. Subsequently, the control device 100 controls the drive control device 42 to perform a first control which is a fixed time control where the number of clocks is fixed (S9), and drives the blade motor 441 to move the second blade 29 toward the sheet P so that the second blade 29 reaches the second folding portion PT2 of the sheet P (S10).

In other words, the control device 100 starts the second sheet folding processing and control the blade motor 441 to press the second blade 29 into the nip N2. At this time, the control device 100 allows the drive control device 42 to drive the roller motor 41 to continue conveyance of the sheet P by the conveyance roller 24, the first sheet folding roller pair 31, the second sheet folding roller pair 32, and so on.

When a predetermined period of time of pressing has elapsed after the control device 100 controls the blade motor 441 to allow the second blade 29 to start pressing the sheet P into the nip N2, the control device 100 rotates the blade motor 441 reversely (S11) to withdraw the second blade 29 from the sheet P and the nip N2.

At the time when the control device 100 rotates the blade motor 441 reversely to withdraw the second blade 29 from the sheet P and the nip N2 (for example, at the time when the second blade 29 goes back to an initial position before the transfer in S10), the control device 100 controls the drive control device 42 to stop the rotation of the roller motor 41 (S12).

When determining that the predetermined period of time T has elapsed after the stop of rotation of the roller motor 41 in S12, the control device 100 controls the drive control device 42 to return the control of the roller motor 41 to, not the first control, but the normal PLL control and PWM control having been performed before the processing in S1, drive the roller motor 41 by the normal PLL control and PWM control (S13), and restart the rotation of the roller motor 41 (S14), thus conveying the sheet P with a second fold line formed therein to the above waiting position. Since in this manner the rotation of the roller motor 41 is once stopped and then restarted, the accumulated gap between the pulse and the number of clocks due to the first control does not affect sheet conveyance control after the restart. Thereafter, the processing ends.

In the above embodiment, since a period of stopping of the roller motor 41 (the above predetermined period of time T) is provided after a fold line is formed in the sheet P, the drive of the motor for sheet folding processing and the drive of the motor for sheet conveyance processing that would generally be continued are not continued, but separated. This prevents an abrupt change in load on the roller motor 41 (occurring during sheet folding processing) from affecting the subsequent sheet conveyance processing and ensures stable sheet conveyance after the sheet folding processing. Therefore, without the use of a large-sized motor, stable sheet conveyance after the sheet folding processing can be achieved.

Figure 5:
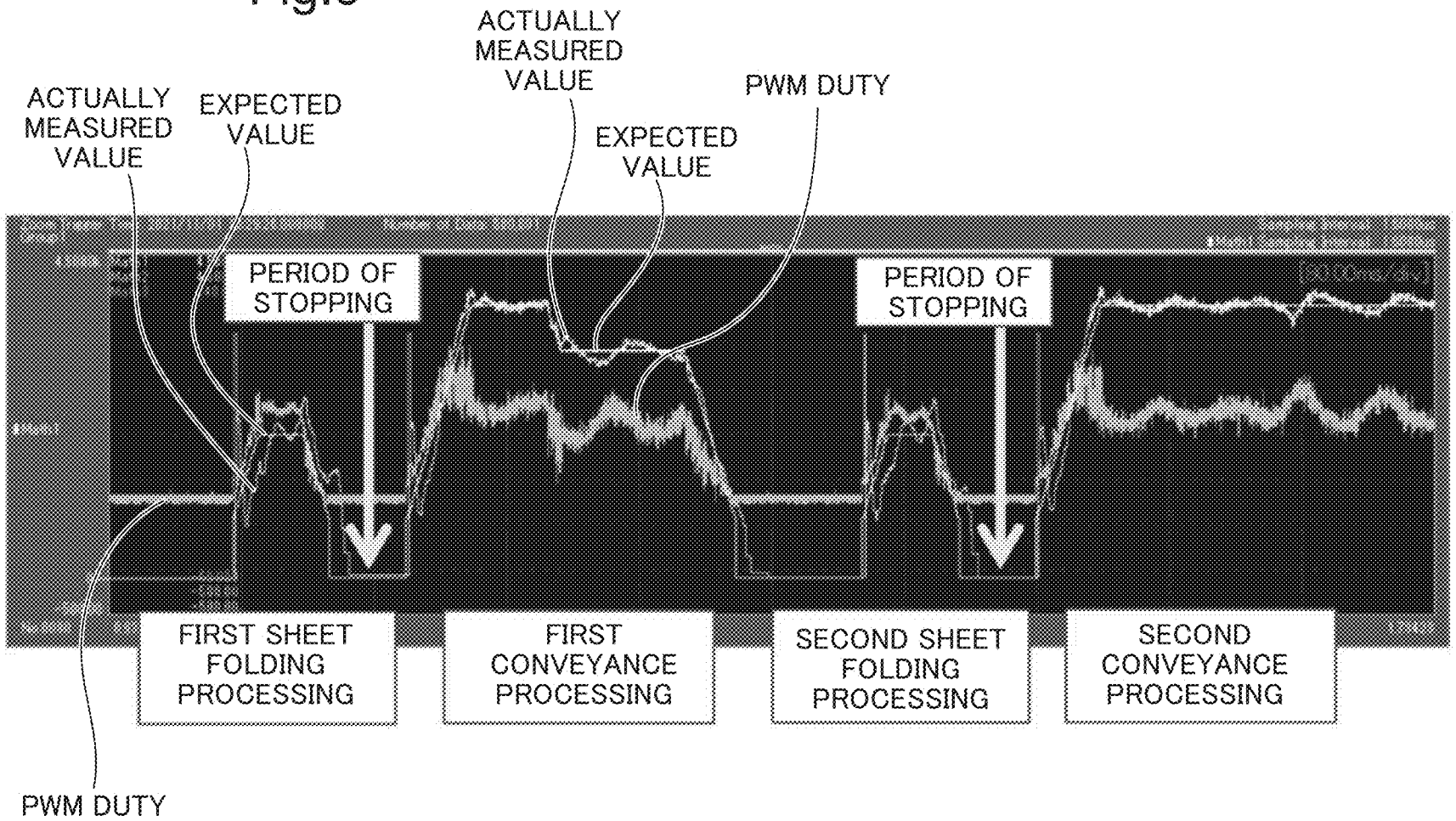
FIG. 5 is a graph showing actually measured and expected values of the rotational speed of a motor and the duty ratio of PWM control when a sheet has been subjected to Z-folding.

FIG. 5 is a graph showing actually measured and expected values of the rotational speed of the roller motor 41 and the duty ratio of PWM control when a sheet P has been subjected to Z-folding. The axis of abscissa represents time and the axis of ordinate represents rotational speed or duty ratio.

In a period of time when the "first sheet folding processing" is performed, the difference between the expected value and actually measured value of the rotational speed is large. However, since the period of stopping when the roller motor 41 is stopped is provided after the "first sheet folding processing", the roller motor 41 is substantially reset. Therefore, while the "first conveyance processing" is performed between the "first sheet folding processing" and the "second sheet folding processing", the duty ratio of PWM control is not fixed at 100% and the actually measured value of the rotational speed slightly differs from the expected value thereof and almost follows it.

Likewise, also while the "second conveyance processing" is performed after the "second sheet folding processing", the duty ratio of PWM control is not fixed at 100% and the actually measured value of the rotational speed slightly differs from the expected value thereof and almost follows it.

Figure 6A:
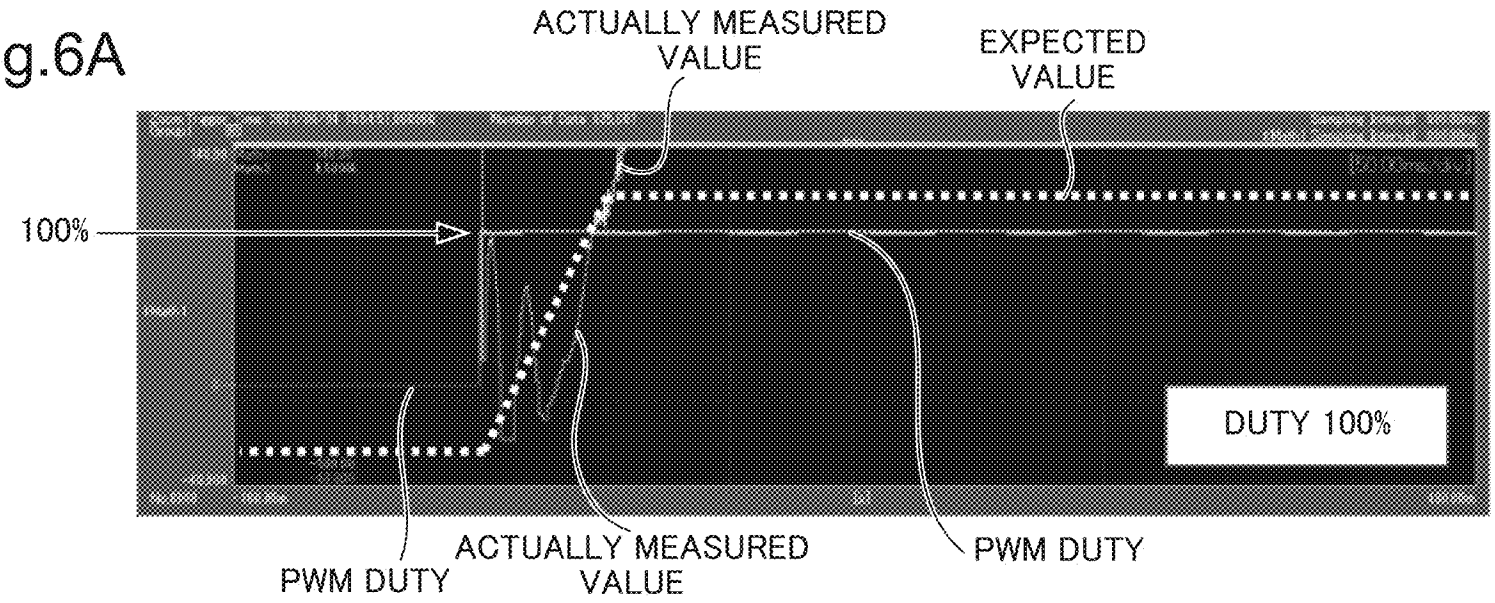
FIG. 6A is a graph showing actually measured and expected values of the motor and the duty ratio of PWM control when a sheet has been subjected to sheet folding processing with the duty ratio of PWM control fixed at 100%.
Figure 6B:
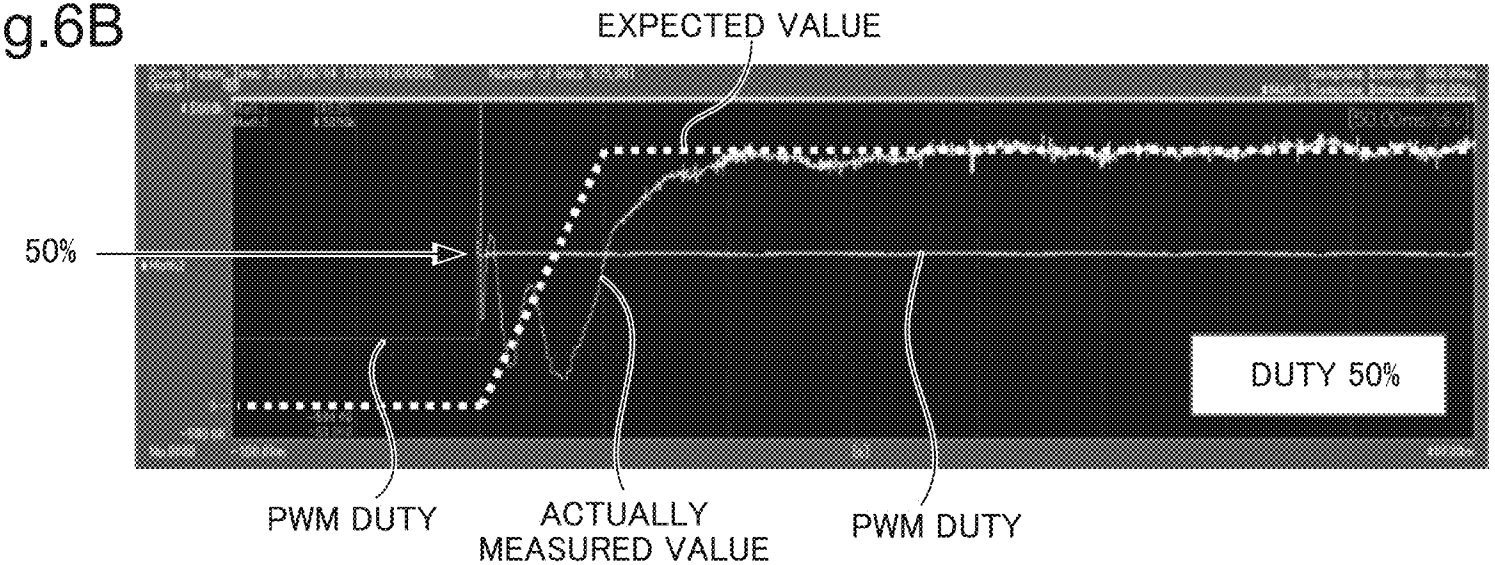
FIG. 6B is a graph showing actually measured and expected values of the motor and the duty ratio of PWM control when a sheet has been subjected to sheet folding processing with the duty ratio of PWM control fixed at 50%.
Figure 7A:
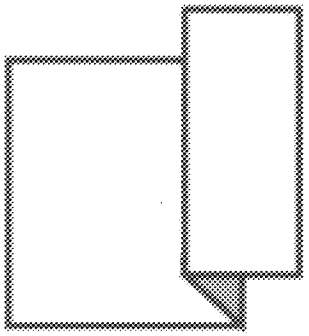
Fig.7A RELATED ART
FIGS. 7A to 7D are views showing various types of sheet folding processing.
Figure 7B:
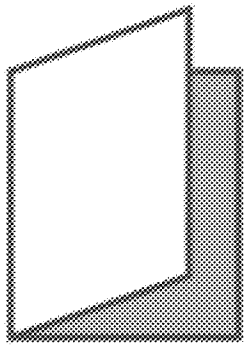
Fig.7B RELATED ART
Figure 7C:
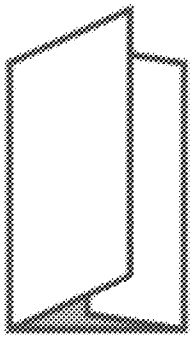
Fig.7C RELATED ART
Figure 7D:
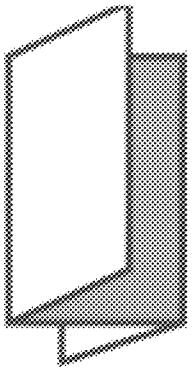
Fig.7D RELATED ART

FIGS. 6A and 6B are graphs showing actually measured and expected values of the roller motor 41 and the duty ratio of PWM control when a sheet P has been subjected to sheet folding processing with the duty ratio of PWM control fixed at 100% or 50%.

When the duty ratio of PWM control is fixed at 100% or 50%, in either case as shown in FIGS. 6A and 6B, a difference occurs between the actually measured value and expected value of the rotational speed due to behavior of the roller motor 41 during sheet folding processing and the rotational speed cannot follow the expected value. However, a fold line can be formed in the sheet P in either case and, therefore, there is no problem in terms of the sheet folding processing itself.

In order to increase the productivity, the fixed time (the fixed number of clocks) during sheet folding processing should be as short as possible. When the duty ratio of PWM control is 100% rather than 50%, the actually measured value is closer to the expected value and the productivity is higher.

With this in mind, in another embodiment, the control device 100 may perform, instead of the first control, a second control in which the control device 100 allows the drive control device 42 to control the drive of the roller motor 41 without performing PLL control and fixes the duty ratio of PWM control at 100%. In other words, the control device 100 fixes the duty ratio of PWM control at 100% for a period of time when the "first sheet folding processing" is performed and for a period of time when the "second sheet folding processing" is performed.

A general post-processing apparatus employs PLL (phase locked loop) control and PWM (pulse width modulation) control for the purpose of controlling a motor for use in rotational drives of a first sheet folding roller pair 31 and a second sheet folding roller pair 32. For example, the post-processing apparatus performs PLL control in which the motor pulse (the rotational speed signal indicating the rotation phase of the motor) is synchronized with the clock signal serving as a basis of an instruction for the rotational speed and controls the time to energize the motor by PWM control, thus controlling the conveyance of the sheet P.

When the folding portions PT1 and PT2 of the sheet P to be fold lines enter the nips N1 and N2 of the first and second sheet folding roller pairs 31 and 32, respectively, a large load is imposed on the motor rotating the first and second sheet folding roller pairs 31 and 32. On the other hand, as soon as the folding portions PT1 and PT2 exit the nips N1 and N2, respectively, the load on the motor significantly decreases. In other words, while the folding portions PT1 and PT2 of the sheet P to be fold lines pass through the nips N1 and N2, respectively, the load on the motor momentarily significantly increases and momentarily significantly decreases. Such abrupt changes in load on the motor may cause overshoots, which makes it difficult to control the sheet position. Therefore, sheet conveyance after the sheet folding processing becomes unstable.

Figure 9:
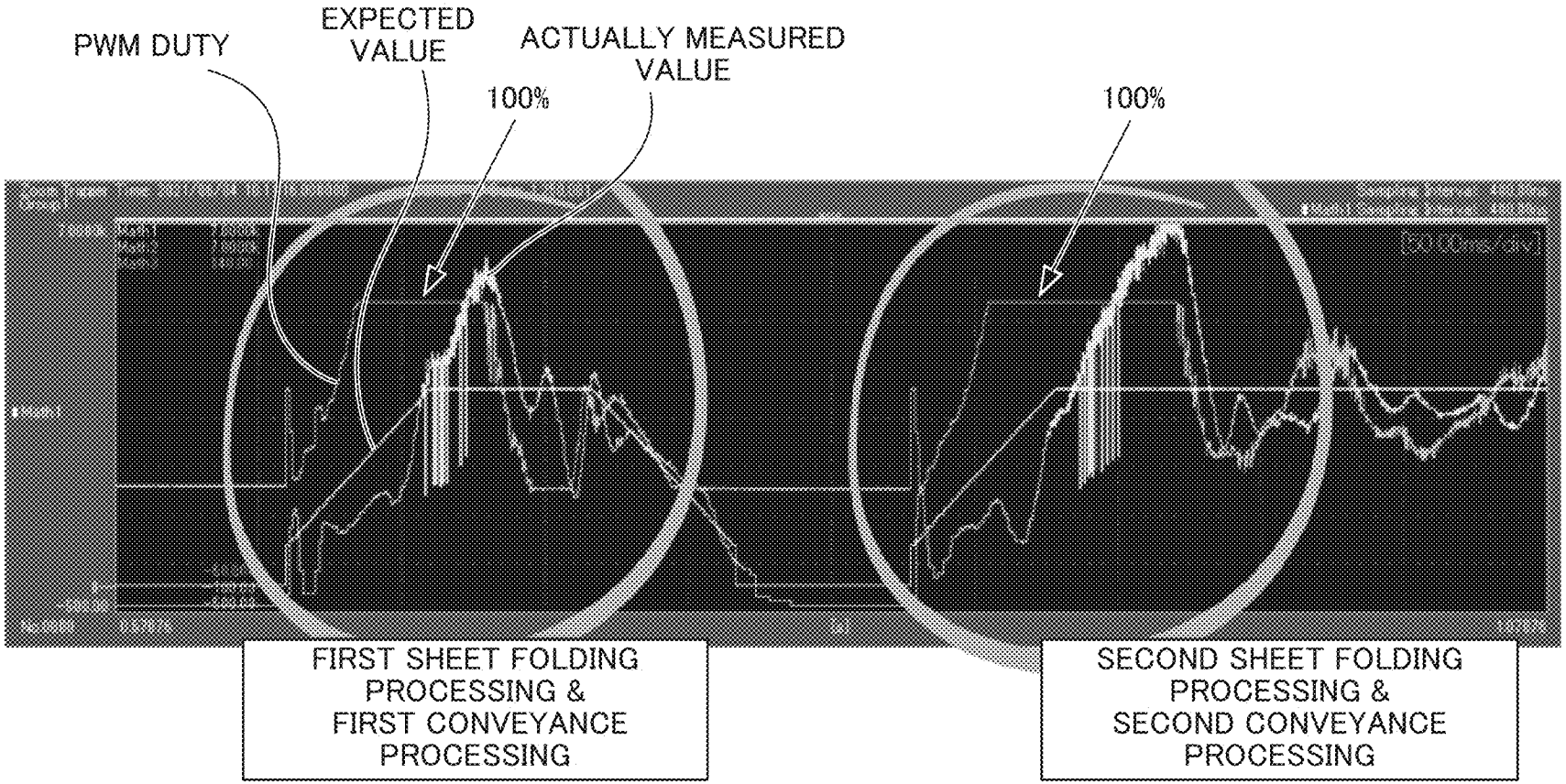
Fig.9 RELATED ART
FIG. 9 is a graph showing actually measured and expected values of the rotational speed of a motor and the duty ratio of PWM control when a sheet has been subjected to Z-folding.

FIG. 9 is a graph showing actually measured and expected values of the rotational speed of the motor and the duty ratio of PWM control when a sheet P has been subjected to Z-folding. The axis of abscissa represents time and the axis of ordinate represents rotational speed or duty ratio. The portion surrounded by a circle in a lower part of the figure represents a period of time when the "first sheet folding processing" and the "first conveyance processing" are performed, while the portion surrounded by a circle in an upper portion of the figure represents a period of time when the "second sheet folding processing" and the "second conveyance processing" are performed.

When the "first sheet folding processing" where the load on the motor abruptly changes is performed and the "first conveyance processing" is successively performed, as shown as an example in FIG. 9, the duty ratio of PWM control is fixed at 100%, the difference between the expected and actually measured values of the rotational speed is large, and an extreme overshoot of the motor rotation thus occurs.

Likewise, also when the "second sheet folding processing" and the "second conveyance processing" are successively performed, the duty ratio of PWM control is fixed at 100%, the difference between the expected and actually measured values of the rotational speed is large, and an extreme overshoot of the motor rotation thus occurs. If a large-sized motor having large torque is used, the probability of occurrence of overshoot may be reduced. However, such a large-sized motor is expensive and generates concern about growth in size of the apparatus.

In addition, it can be contemplated to perform sheet folding processing according to the sheet type by changing the rotational speed of the motor rotating the sheet folding roller pairs. However, a change in rotational speed may decrease the productivity.

Unlike the above, in the post-processing apparatus 2 described in each of the above embodiments, stable sheet conveyance after the sheet folding processing can be achieved, without the use of any large-sized motor, for the above-described reasons.

The present disclosure is not limited to the above embodiments and can be modified in various ways. Furthermore, the structures, configurations, and processing of the embodiments described with reference to FIGS. 1 to 9 are merely illustrative and are not intended to limit the present disclosure to them.

While the present disclosure has been described in detail with reference to the embodiments thereof, it would be apparent to those skilled in the art the various changes and modifications may be made therein within the scope defined by the appended claims.

What is claimed is:

1. A post-processing apparatus mounted to an image forming apparatus and capable of subjecting a sheet to post-processing, the post-processing apparatus comprising:

a blade capable of being pressed into the sheet to form a fold line in the sheet;

a transfer mechanism that moves the blade toward and away from the sheet;

a sheet folding roller pair that conveys the sheet with the fold line formed therein by the blade by pinching the sheet at a nip between the sheet folding roller pair;

a motor that rotatively drives the sheet folding roller pair;

a drive control device that controls drive of the motor; and a control device that is formed of a control circuit including a processor and controls the transfer mechanism and the drive control device, wherein at a time when the control device controls the transfer mechanism to withdraw the blade, which has been pressed into the sheet and the nip by the transfer mechanism, from the nip, the control device controls the drive control device to stop the motor, wherein the drive control device controls the drive of the motor by PLL control and PWM control, and for at least a period of time from when the control device drives the transfer mechanism to allow the blade to start pressing into the sheet to when the control device drives the transfer mechanism to allow the blade to end the pressing, the drive control device controls the drive of the motor without performing the PLL control and fixes a duty ratio of the PWM control at 100%.

2. An image formation system comprising:

an image forming apparatus comprising an image forming device that forms an image on a recording medium; and the post-processing apparatus according to claim 1.

* * * * *